US012808617B2

(12) United States Patent
Fielder

(10) Patent No.: US 12,808,617 B2
(45) Date of Patent: Nov. 24, 2026

(54) FIREARM WITH INTEGRAL AMMUNITION CHAMBER

(71) Applicant: Ricky Jackson Fielder, Mt. Juliet, TN (US)

(72) Inventor: Ricky Jackson Fielder, Mt. Juliet, TN (US)

( * ) Notice: Subject to any disclaimer, the term of this patent is extended or adjusted under 35 U.S.C. 154(b) by 0 days.

(21) Appl. No.: 18/828,566

(22) Filed: Sep. 9, 2024

(65) Prior Publication Data

US 2025/0109918 A1 Apr. 3, 2025

Related U.S. Application Data

(60) Provisional application No. 63/537,499, filed on Sep. 9, 2023.

(51) Int. Cl.
*F41A 3/66* (2006.01)
*F41A 9/52* (2006.01)

(52) U.S. Cl.
CPC . *F41A 3/66* (2013.01); *F41A 9/52* (2013.01)

(58) Field of Classification Search
CPC ..... F41A 9/52; F41A 9/82
See application file for complete search history.

(56) References Cited

U.S. PATENT DOCUMENTS 4,430,821 A * 2/1984 Vincent ..... F41A 9/67 42/50
6,212,814 B1 * 4/2001 Lambie ..... F41A 11/02 42/75.03
9,121,652 B1 * 9/2015 Mangiameli ..... F41A 9/64
9,341,421 B2 * 5/2016 Findlay ..... F41A 3/58

* cited by examiner

*Primary Examiner* — Reginald S Tillman, Jr.
(74) *Attorney, Agent, or Firm* — Hornkohl Intellectual Property Law; Jason L. Hornkohl

(57) ABSTRACT

A restricted capacity firearm having an internal, integral ammunition chamber, and a method and device for converting an existing magazine fed firearm, such as an AR-15 semi-automatic rifle and/or semi-automatic pistol, into a restricted capacity firearm having an internal, integral ammunition, chamber are provided. In accordance therewith, the existing lower receiver of an AR-15 may be replaced with a new lower receiver having an internal, integral ammunition chamber. The new lower receiver may be configured so that the firearm may be opened using the existing pivot pin of the AR-15 to allow refilling of the ammunition chamber. Alternatively, the replacement lower receiver may be configured such that the internal, integral ammunition chamber can only be refilled by disassembling the firearm. A handheld semi-automatic pistol frame and slide embodiment may also be configured to contain an internal, integral ammunition chamber with limited capacity.

8 Claims, 9 Drawing Sheets

FIREARM WITH INTEGRAL AMMUNITION CHAMBER

CROSS-REFERENCES TO RELATED APPLICATIONS

The present application claims priority from U.S. Provisional Patent Application No. 63/537,499, filed Sep. 9, 2023, and entitled "Firearm with Integral Ammunition Chamber" which is hereby incorporated by reference.

TECHNICAL FIELD

This disclosure generally relates to a firearm having an integral ammunition chamber and a corresponding method and device for converting an existing magazine fed firearm into a firearm having an integral ammunition chamber.

INTRODUCTION

A magazine is a detachable ammunition storage and feeding device for a repeating firearm. A magazine functions by holding several cartridges within itself and sequentially pushing each one into a position where it may be readily loaded into the barrel chamber by the firearm's moving action. Magazine are typically designed to be quickly replaced to facilitate the reloading process.

A high-capacity magazine ban is a law which bans or otherwise restricts high-capacity magazines, detachable firearm magazines that can hold more than a certain number of rounds of ammunition. For example, some jurisdictions have bans or limits regarding detachable magazines that can hold more than ten rounds. With regard to jurisdictions having high-capacity magazine bans or restrictions, these restrictions typically do not apply to firearms with fixed magazines whose capacity would otherwise exceed the high-capacity threshold.

A modern handheld firearm is generally regarded as any semi-automatic firearm roughly based or similar to the original 1890's John Browning 1911 design. An AR-15-style rifle is generally regarded as any lightweight semi-automatic rifle roughly based on the original Colt™ AR-15 design. After the patents directed toward the original Colt™ AR-15 design expired, many firearm manufacturers produced copies of the original version under their own names. Today, AR-15 style or platform rifles are one of the most popular styles of rifles sold in the United States.

SUMMARY

Embodiments of the present invention are generally directed toward restricted capacity firearms having an internal, integral ammunition chamber that limits the number of rounds that can be quickly fired by the firearm, and devices and methods for converting existing magazine fed firearms into such restricted capacity firearms. The benefits of restricted capacity firearms include eliminating high-capacity ammunition capabilities by eliminating the various external magazine reloading options. Accordingly, the rapid reloading capability provided by using an external magazine is eliminated.

An embodiment of the present invention is directed toward a lower receiver for a rifle. The lower receiver comprises an internal ammunition chamber that can only be re-filled with ammunition by opening the lower receiver. The lower receiver comprises a pivot plate configured to couple to a lower portion of the lower receiver and form a bottom of the internal, integral ammunition chamber. A coil-spring is mounted on the pivot plate and a follower is mounted on the coil spring. In some embodiments, the pivot plate is coupled to the lower portion of the lower receiver with a pivot pin and door catch. The pivot plate may include features configured to receive the coil spring and keep it firmly in place with respect to the pivot plate and the follower may include features configured to receive the coil spring and keep it firmly in place with respect to the follower.

In some embodiments, the lower receiver is adapted to replace an existing lower receiver of a magazine fed rifle where the existing lower receiver is configured to receive removable ammunition magazines. The rifle may be an AR-15 platform rifle and the lower receiver configured so that the rifle may be opened using an existing pivot pin of the AR-15 to allow refilling of the ammunition chamber. If desired, a design may be formed on an exterior surface of the lower receiver to identify its distinct functionality, brand etc.

Another embodiment of the present invention is directed toward a method of restricting the ammunition capacity of a firearm. The method comprises replacing a portion of the firearm adapted to receive a removable ammunition magazine with a replacement portion having an internal ammunition chamber that must be manually refilled with ammunition. In some embodiments, the portion of the firearm is a lower receiver for a rifle and the replacement portion comprises a replacement lower receiver having an internal ammunition chamber. The rifle may be an AR-15 platform rifle and the lower receiver configured so that the firearm can be opened using the existing pivot pin of the AR-15 to allow refilling of the ammunition chamber. In other embodiments, the portion of the firearm is a frame for a pistol and the replacement portion comprises a replacement frame. The replacement frame may be configured so that the internal ammunition chamber can be reloaded by moving a slide of the pistol. In other embodiments, the internal ammunition chamber can only be refilled by at least partially disassembling the firearm.

An embodiment is also directed toward a replacement frame for a magazine fed pistol having a slide and an existing frame configured to receive a magazine. The replacement frame comprises an internal ammunition chamber that can only be refilled with ammunition by moving the slide of the pistol or opening the replacement frame. A bottom plate on a lower portion of the replacement frame pivots open to provide access to the internal ammunition chamber. The replacement frame may further comprise a design formed on an exterior surface of the replacement frame.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

A firearm having an internal, integral ammunition chamber and a method and device for converting an existing magazine fed firearm, such as an AR-15, into a firearm having an internal, integral ammunition chamber, are provided. In accordance therewith, the existing lower receiver of an AR-15 may be replaced with a lower receiver having an internal, integral ammunition chamber. The firearm may be opened using the existing pivot pin of the AR-15 to allow refilling of the ammunition chamber. Alternatively, the replacement lower receiver may be configured such that the internal, integral ammunition chamber can only be refilled by disassembling the firearm.

Figure 1A:
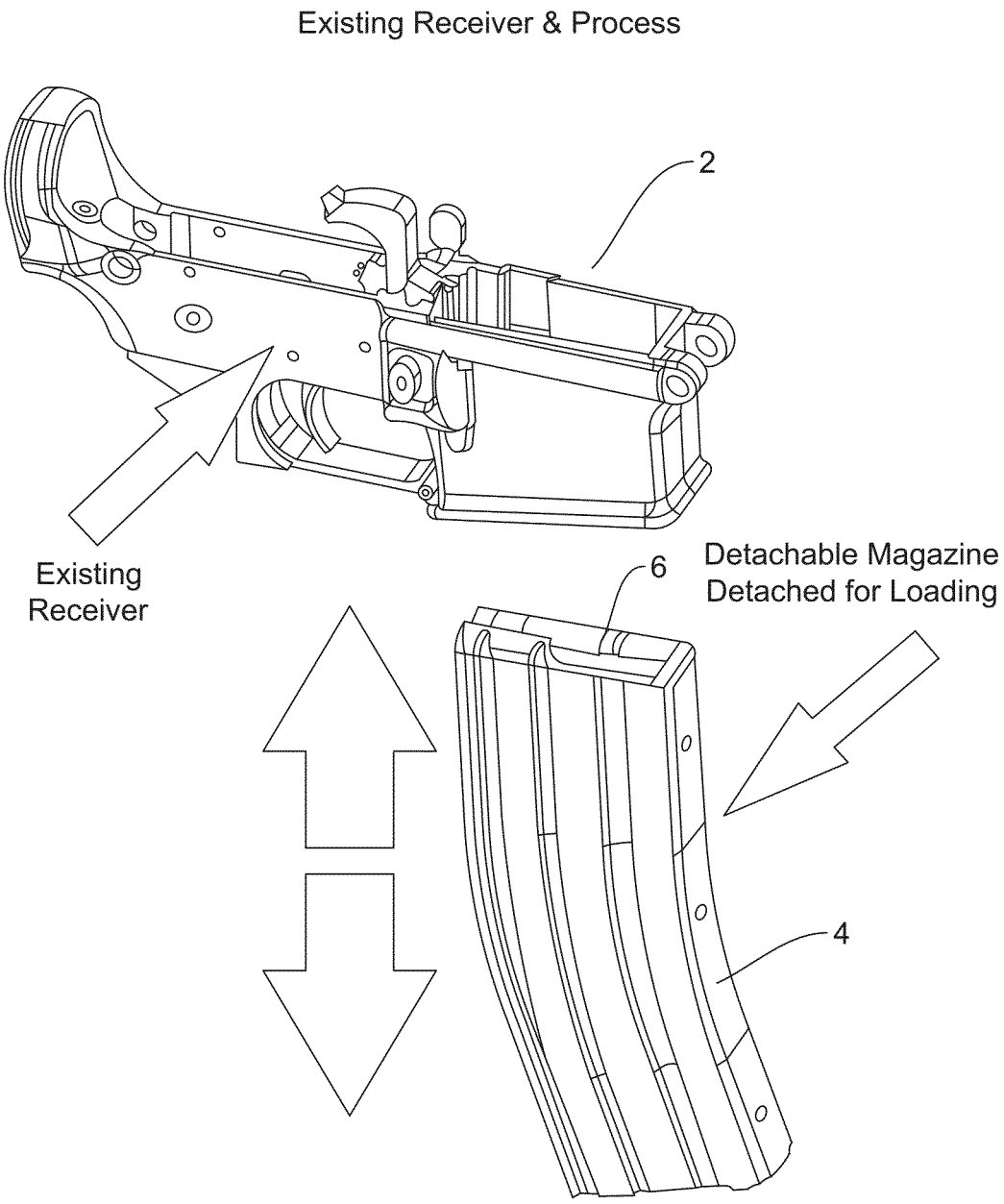
FIGS. 1(A) and 1(B) are illustrations of the construction and functioning of a prior art lower receiver for an AR-15 style or platform rifle.
Figure 1B:
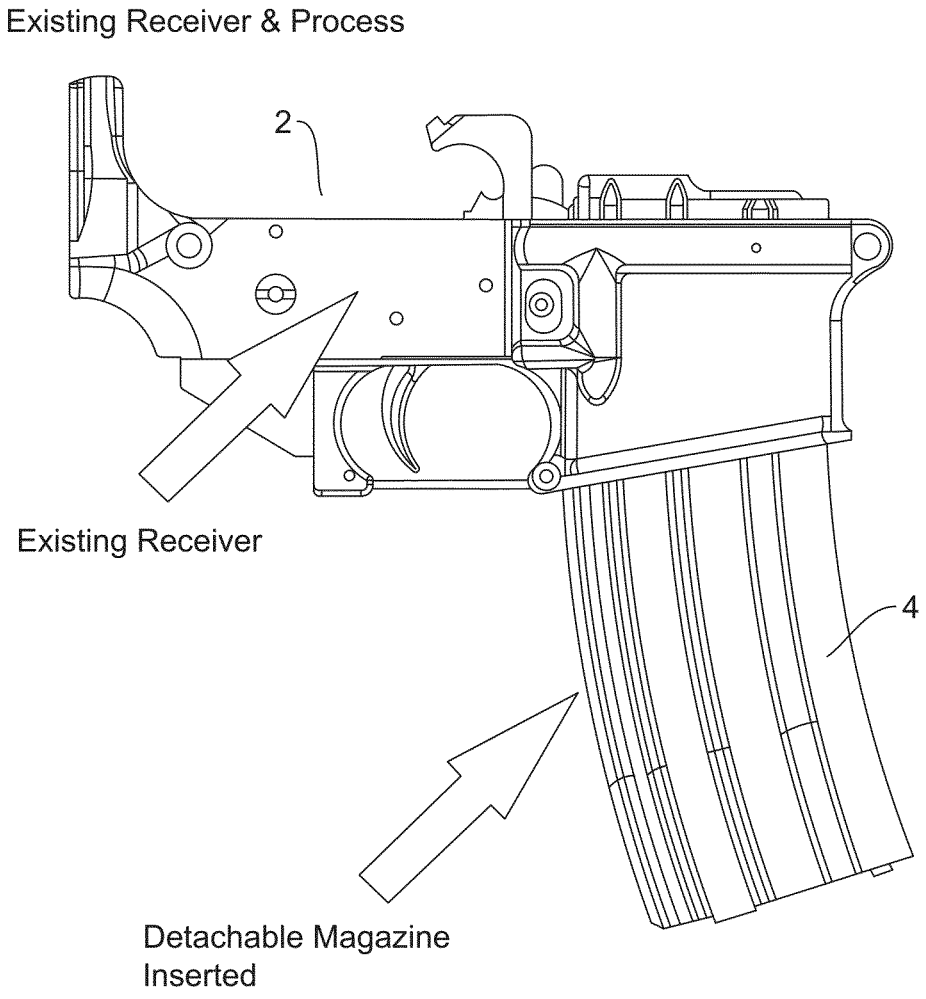
Figure 2A:
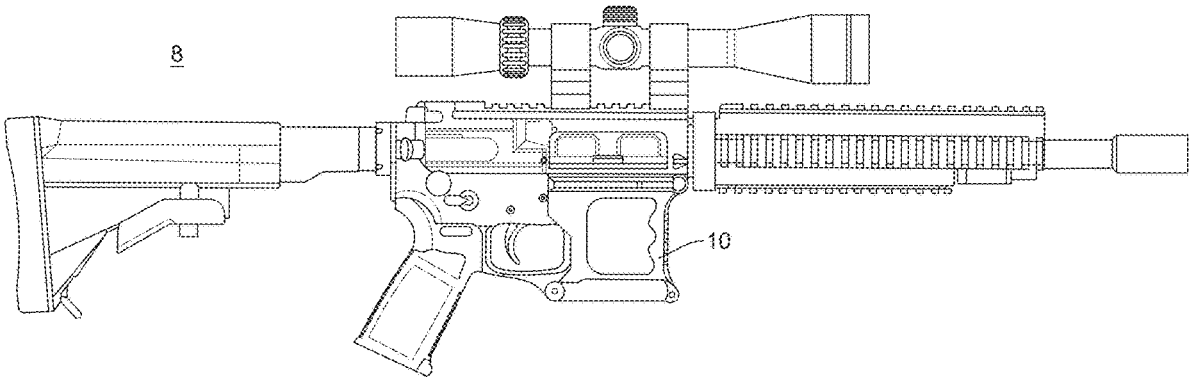
FIGS. 2(A) and 2(B) are illustrations of an AR-15 style or platform rifle constructed in accordance with an embodiment of the present invention.

FIGS. 1(A) and 1(B) are illustrations of the construction and functioning of a prior art lower receiver 2 and magazine 4 for an AR-15 style or platform rifle. As is standard, the prior art lower receiver 2 receives a detachable magazine 4 which contains the ammunition 6 for the rifle. FIG. 1(A) is an illustration of the prior art lower receiver 2 with the magazine 4 detached and FIG. 2(A) is an illustration showing the prior art lower receiver 2 with the magazine 4 inserted into the receiver 2. The magazine 4 is designed to be very easily and quickly removed from the receiver 4 and replaced with a fresh preloaded magazine 4. Further, there a very few inherent limitations as to how many rounds of ammunition 6 the prior art magazine 4 may contain as magazines 4 of varying capacities are easily adapted to be inserted into the receiver 2. However, as discussed herein, there may be legal limitations placed on the amount of ammunition 6 which a magazine 4 is allowed to contain.

Figure 2B:
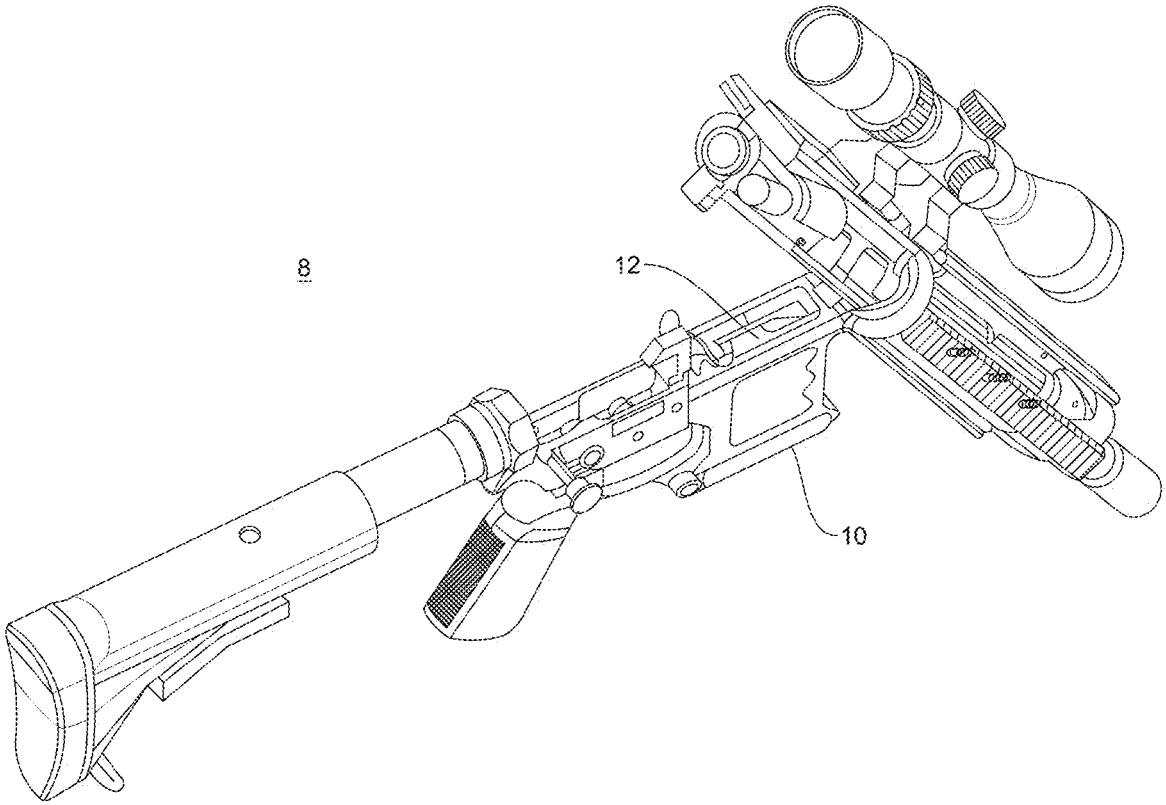

While some embodiments of the invention are discussed with regard to a particular style or platform of firearm, it will be readily appreciated that the integral ammunition chamber concept can be adapted for different styles or platforms of firearm. FIGS. 2(A) and 2(B) are illustrations of an embodiment of the present invention adapted for an AR-15 platform rifle 8. In the embodiment of FIGS. 2(A) and 2(B), the prior art lower receiver 2 and detachable magazine 4 of FIGS. 1(A) and 1(B) have been replaced with a single lower receiver 10 having an integral, internal ammunition chamber. The lower receiver 10 does not contain a magazine mount for receiving a magazine. Rather, the ammunition is contained within the lower receiver 10 itself. As such the rifle 8 cannot be reloaded by simply inserting a new magazine. Rather, the rifle 8 is limited to quickly firing the amount of ammunition preloaded into the integral ammunition chamber in the lower receiver 10 after which the rifle 8 must be reloaded pursuant to a relatively slow process.

The exemplary embodiment of FIGS. 2(A) and 2(B) can be, for example, operated as follows.

Step 1. Verify the rifle 8 is unloaded and return the (BCG) of the rifle 8 into the battery.

Step 2. Place the safety selector of the rifle 8 on SAFE.

Step 3. Press the takedown pin inward from the left then pull outward from the right side of the lower receiver until stops at the detents, Step 4. Pivot the lower receiver 10 open.

Step 5. Insert the proper ammunition cartridge into the internal ammunition chamber 12 by pushing the cartridge downward into the ammunition chamber 12. For the embodiment shown, the maximum capacity is 10 cartridges. However, those skilled in the art will appreciate that the capacity of the internal ammunition chamber can readily be varied to suit the needs of any particular embodiment.

Step 6. Pivot the lower receiver 10 closed.

Step 7. Press the take down pin inward from the right until fully seated.

Step 8. To chamber a cartridge, fully retract the charging handle and freely release it.

Step 9. Assume the safe shooting position and direction when ready to fire. Firmly grip the pistol grip of the rifle 8 in one hand and the handguard in the other hand with the buttstock to your shoulder. The rifle 8 is ready to be fired.

Figure 3:
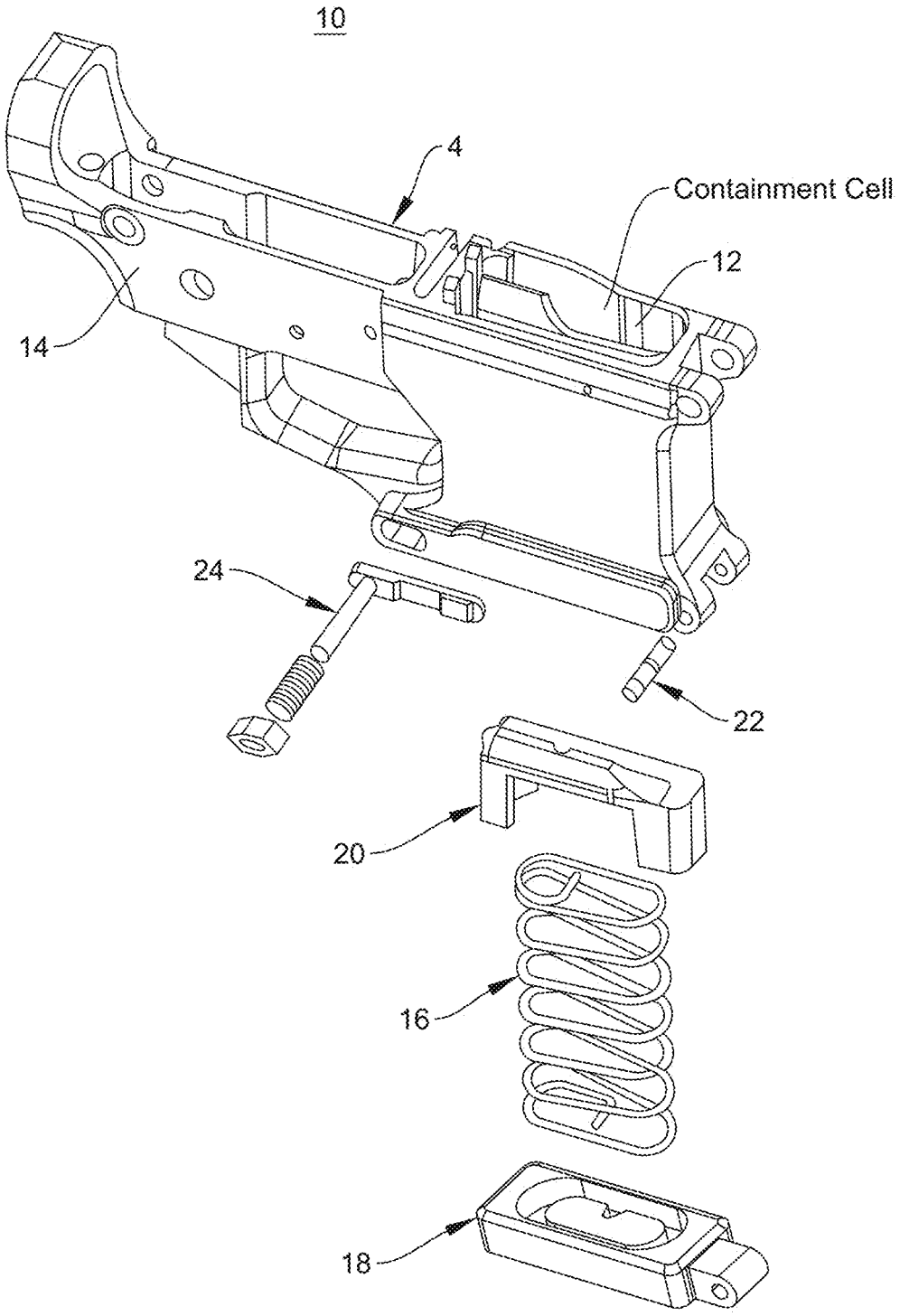
FIG. 3 is an exploded view illustration of the components of the lower receiver of the embodiment of FIG. 2.

FIG. 3 is an exploded view illustration of the lower receiver 10 of the embodiment of FIGS. 2(A) and 2(B). As shown, the lower receiver 10 includes a main body assembly 14 that includes an internal ammunition chamber 12 that receives the cartridges. If the lower receiver 10 is a replacement for an existing lower receiver, such as that of an AR-15, the main body assembly 14 of the replacement lower receiver is configured to resemble that of the existing lower receiver such that it supports the remaining components of the firearm as designed. A coil spring 16 is mounted on a pivot plate 18 at one end and on a follower 20 at the other end. The pivot plate 18, coil 16 and follower 20 are configured to be mounted in a lower open portion of the internal ammunition chamber 12 as shown and function to provide ammunition progressively and smoothly to the firing chamber of the rifle 8. A pivot pin 22 and a door catch 24 function to allow the pivot plate 18 to be rotatably opened to access the internal ammunition chamber 12 from the bottom of the lower receiver 10.

Figure 4:
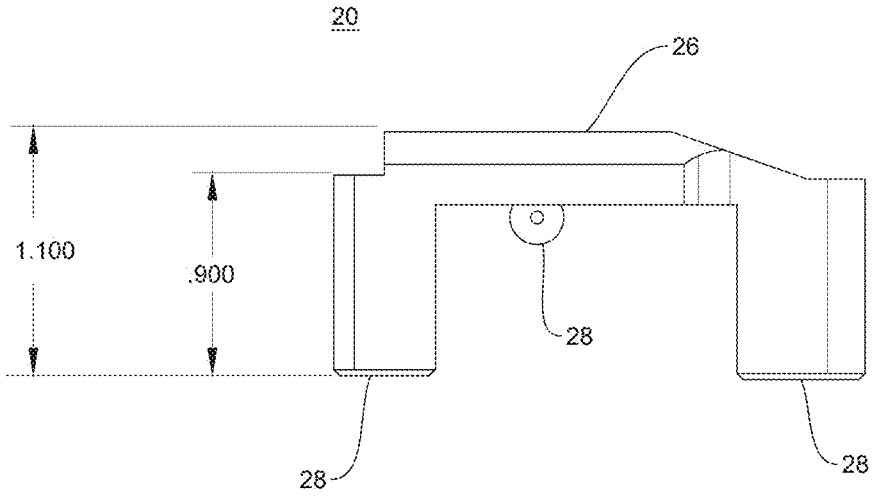
FIG. 4 is an illustration of the follower of the embodiment of FIG. 2.

FIG. 4 is a detailed illustration of the follower 20 for the embodiment of FIG. 2. The follower 20 includes upper features 26 that hold the ammunition in place on top of the follower 20 and lower features 28 that function securely hold the coil spring 16 in pace with respect to the follower 22. The follower 20 may also have features such as pins and slots to properly align it in the ammunition chamber and a stop to limit its upward motion.

Figure 5:
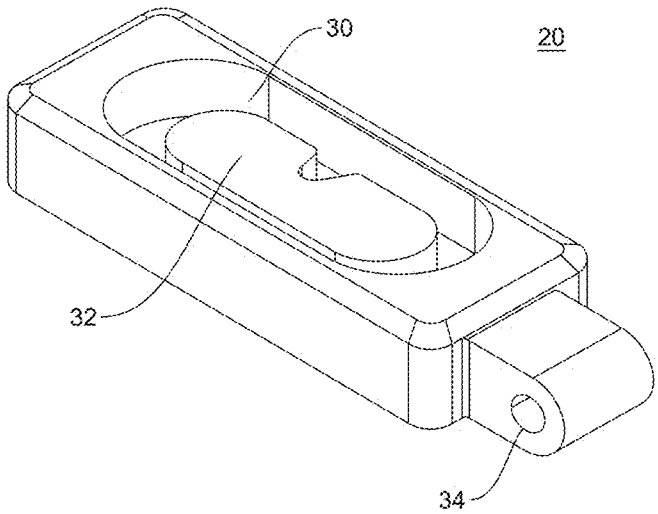
FIG. 5 is an illustration of the pivot plate of the embodiment of FIG. 2.

FIG. 5 is a close up illustration of the pivot plate 18 for the embodiment of FIG. 2. The pivot plate 18 includes features 30 and 32 configured to receive the coil spring 16 and keep it firmly in place with respect to the pivot plate 18. A hole 34 in the pivot plate 18 is configured to receive the pivot pin 22 so that the pivot plate 18 can be mounted on the lower receiver 12 and rotate around the pivot pin 22.

Figure 6:
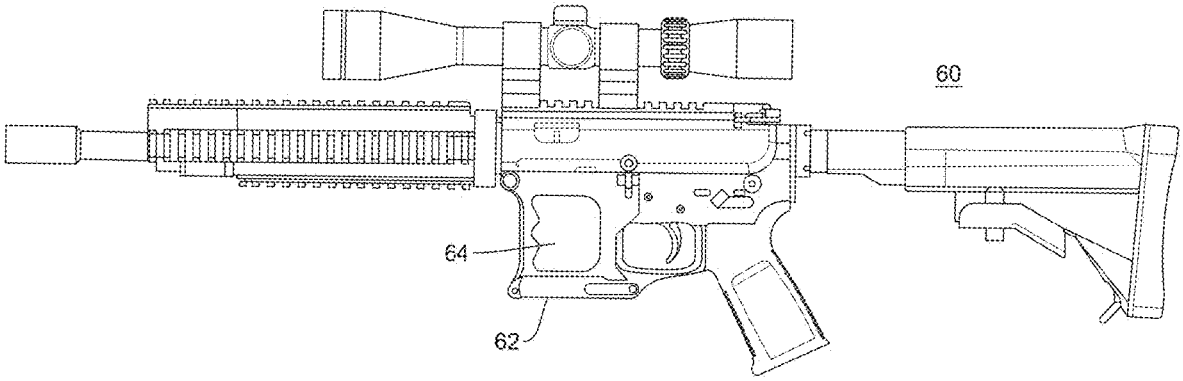
FIG. 6 is an illustration of an assembled AR-15 modified in accordance with another embodiment of the present invention.

FIG. 6 is an illustration of an assembled AR-15 platform rifle 60 modified in accordance with an embodiment of the present invention. As shown in the embodiment of FIG. 6, a lower receiver 62 having an integral ammunition chamber in accordance with various embodiments can have different aesthetic features, branding, etc. 64 engraved or otherwise formed on the surfaces of the lower receiver 62 as desired.

A handheld semi-automatic pistol frame and slide embodiment may also be configured to contain an internal, integral ammunition chamber with limited capacity. For example, a replacement for the frame of an existing semi-automatic pistol frame, such as a Glock™ style semi-automatic pistol, may be constructed so that the existing frame and removable magazine are replaced with a compatible replacement frame having an internal, integral ammunition chamber with limited capacity as described herein. The replacement frame of the semiautomatic pistol may be constructed to hold any reasonable amount of ammunition desired.

Figure 7:
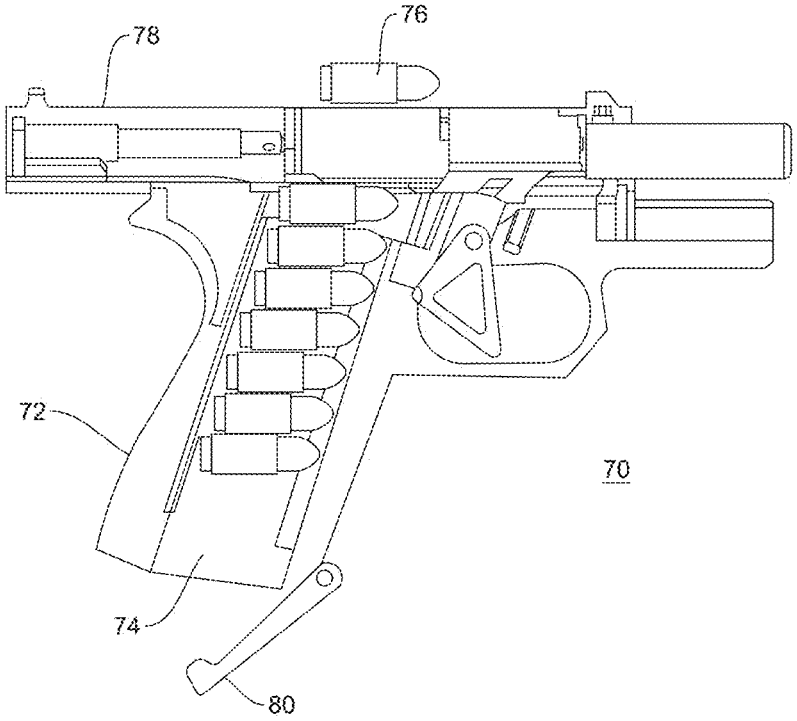
FIG. 7 is an illustration of an embodiment of the invention adapted for a Glock™ pistol.

FIG. 7 is an illustration of an embodiment of the invention adapted for a Glock™ style pistol 70. In the embodiment shown, the frame of a standard Glock style pistol has been replaced with a compatible replacement frame 72 having an internal, integral ammunition chamber 74 with a limited ammunition 76 capacity. The process for use is somewhat similar to the process described above with respect to the rifle embodiment.

As shown in FIG. 7, the slide 78 of the pistol is drawn rearward and locked in place to gain access to the internal, integral ammunition chamber 74. Ammunition is then loaded into the pistol by pushing it into the chamber 74 in a manner similar to that described for a rifle above. When the amount of ammunition 76 required for use is inserted the internal, integral ammunition chamber 74, the slide 78 must be unlocked and moved into the firing position. This results in a round being simultaneously chambered into the barrel and the pistol ready to be fired. After the rounds are fired and the chamber 74 is empty, the 78 slide can again be moved to the reloading position and locked into place. The loading procedure can be repeated as required. If debris contaminate the chamber 74 or there is a misfire, the bottom plate 80 can be opened to release the contents of the chamber 74. In an alternative embodiment, the frame 72 can be loaded by opening the bottom plate 80 and inserting the ammunition or partially disassembling the pistol 70 by removing the frame 72 from the rest of the pistol assembly.

It will be appreciated by persons skilled in the art that the present invention is not limited to the particular embodiments shown and described herein above and that a variety of modifications and variations are possible in light of the above teachings.

What is a claimed is:

1. A lower receiver for a rifle, the lower receiver comprising:

an internal ammunition chamber that can only be re-filled with ammunition by opening the lower receiver;

a pivot plate configured to couple to a lower portion of the lower receiver and form a bottom of the internal ammunition chamber;

a coil-spring mounted on the pivot plate; and a follower mounted on the coil spring.

2. The lower receiver of claim 1 wherein the pivot plate is coupled to the lower portion of the lower receiver with a pivot pin and door catch.

3. The lower receiver of claim 1 wherein the pivot plate includes features configured to receive the coil spring and keep it firmly in place with respect to the pivot plate.

4. The lower receiver of claim 1 wherein the follower includes features configured to receive the coil spring and keep it firmly in place with respect to the follower.

5. The lower receiver of claim 1 wherein the lower receiver is adapted to replace an existing lower receiver of a magazine fed rifle, the existing lower receiver configured to receive removable ammunition magazines.

6. The lower receiver of claim 1 wherein the rifle is an AR-15 platform rifle.

7. The lower receiver of claim 6 wherein the lower receiver is configured so that the rifle may be opened using an existing pivot pin of the AR-15 to allow refilling of the internal ammunition chamber.

8. The lower receiver of claim 1 further comprising a design formed on a surface of the lower receiver.

* * * * *